US006051763A

United States Patent [19]

Poux

[11] Patent Number: 6,051,763

[45] Date of Patent: Apr. 18, 2000

[54] MECHANICAL MUSIC BOX

[76] Inventor: André Poux, 39, avenue Petit-Senn, CH-1225 Chêne-Bourg, Switzerland

[21] Appl. No.: 09/101,522

[22] PCT Filed: Jan. 13, 1997

[86] PCT No.: PCT/CH97/00010

§ 371 Date: Jul. 10, 1998

§ 102(e) Date: Jul. 10, 1998

[87] PCT Pub. No.: WO97/25707

PCT Pub. Date: Jul. 17, 1997

[30] Foreign Application Priority Data

Jan. 12, 1996 [CH] Switzerland ..... 621/96

[51] Int. Cl.[7] ..... G10F 1/06

[52] U.S. Cl. ..... 84/95.1

[58] Field of Search ..... 84/94.1, 94.2, 84/95.1, 95.2, 96; 40/410, 411; 446/270, 271, 297, 303, 397, 408

[56] References Cited

U.S. PATENT DOCUMENTS

| | | | |
|---|---|---|---|
| 335,843 | 2/1886 | Richardson | 84/95.2 |
| 356,251 | 1/1887 | Junod | 84/95.1 |
| 1,314,950 | 9/1919 | Desmond | 84/96 |
| 1,734,770 | 11/1929 | Kayan | 84/95.1 |
| 2,570,976 | 10/1951 | Patz | 84/96 |
| 3,685,382 | 8/1972 | Matthey | 84/95.1 |
| 3,688,626 | 9/1972 | Cotey | 84/95.1 |
| 5,449,856 | 9/1995 | Nakamori | 84/95.1 |
| 5,703,305 | 12/1997 | Isaka | 84/95.1 |

FOREIGN PATENT DOCUMENTS

| | | |
|---|---|---|
| 310524 | 12/1955 | Switzerland . |
| 311255 | 1/1956 | Switzerland . |
| 458034 | 8/1968 | Switzerland . |
| 586441 | 3/1977 | Switzerland . |
| 997 | 5/1989 | Switzerland . |

*Primary Examiner*—Robert E. Nappi
*Assistant Examiner*—Kim Lockett
*Attorney, Agent, or Firm*—Pitney, Hardin, Kipp and Szuch LLP

[57] ABSTRACT

A clam housed mechanical music box for stuffed toys and other amusement devices having two identical frame halves containing and supporting all of the components of the music box. The music box has cylinders which drive music rollers equipped with lifting cams. The lifting cams actuate spring pins to produce the notes of a tune. The drive mechanism for the cylinders is provided by at least one spiral spring attached at one end to a core attached to the central axis and at the other to the cylinder. The drive mechanism also includes a speed regulating mechanism to maintain a steady music tempo throughout the tune, a winding shaft to wind the spring and external power supply shafts to supply power to objects external to the music box mechanism.

9 Claims, 9 Drawing Sheets

MECHANICAL MUSIC BOX

BACKGROUND

The invention refers to a mechanical music box consisting of a set of pieces assembled between two identical frame halves and able to play, using analog techniques, one or more selected melodies in which the musical tone is obtained using a variable number of spring pins, which are alternately lifted and released to produce the desired musical notes.

This invention relates, but is not limited to, the type of mechanical musical box used in clockworks and jewelry, snuffboxes, singing birds, stuffed animals, boxes, display units, and various trinkets.

Traditional music box designs and manufacturing techniques require large complex factories or long and delicate assembly procedures using highly qualified staff and do not permit the mass scale production of a music box capable of playing any kind of repetitive tune, for only a few cents per unit.

A relatively simple to manufacture music box is described in Swiss Patent No. CH-586 441. This music box contains a cylinder (4) equipped with teeth (5) to work vibrating pins (3). In one of its embodiments, a spring (20) is placed inside the cylinder to get it to rotate. The music box pieces are placed in a case (1).

Though it works perfectly well, this music box has a number of problems. One problem is that although the case consists of two parts which make it possible to position and hold the music box components, these two parts are not identical. They therefore have to be made using two different molds, resulting in rather high manufacturing cost. Another problem is that the vibrating pins of the music box are integrally formed as either one or two combs. If, during production, one of the pins breaks or cannot be used for some other reason, the entire comb is unusable. A further problem is that the rewinding mechanism is firmly attached to the cylinder. This means that it cannot be attached in other positions, nor can it have a different shape. This music box, therefore, cannot be adapted and modified to different embodiments. Finally, it is impossible to add a power supply shaft from the music box to drive external components. All of these drawbacks indicate that the music box described in Swiss Patent No. CH-586 441 is largely inflexible and cannot be adapted to different uses.

Swiss Patent No. CH-256 248 describes a music box with individual vibrating tabs in place of the vibrating pins integrally formed as a comb, found in conventional music boxes. However, attaching the tabs in this music box is relatively complicated, making assembly expensive.

For the foregoing reasons, there is a need for a music box that can be easily adapted to a variety of uses, play any type of repetitive tune and be manufactured on a mass scale at a lower cost than known music boxes.

SUMMARY OF THE INVENTION

The invention herein solves these problems by providing a mechanical music box wherein the majority of the components making up the mechanical music box are assembled between two identical frame halves.

A primary object of the present invention is to provided a music box including two identical frame halves, that when placed end to end, enclose and support substantially all of the components of the music box, wherein substantially all of the components are supported by radial open mating half bearings located along the median axis of each of the mating frame halves. These features of the invention make it easier to position the components and assemble the music box, and less expensive to manufacture.

The two identical frame halves can be manufactured at low cost by using a single mold for both halves without the need to use lateral or oblique demolding valves, by injecting plastic containing metallic particles. The two frame halves have integrally molded radially open mating half bearings for locating and holding the music box components. The components are assembled in the bearings on the two frame halves and the two frame halves are then placed end to end. As the frame halves are placed end to end, and are joined together by mating tongues and grooves located all around the outer frame, the components are centered and aligned. These principles enable a substantial reduction in the number of parts and a space saving of about 30% with respect to the state of the art.

One or two music rollers with lifting cams are pushed onto cylinders which drive the rollers. The cylinders are supported by a central axis and driven by a spiral spring.

A speed regulation system gear train is located along the frame's median axis providing a new esthetic appearance and a decrease in the effective force of one or more of the spiral springs due to improved spacing of the transmission gears acting in turn to drive the one or more rollers and to stabilize the tempo of the tune, which must produce even tempo music for as long as possible.

A rewinding mechanism contacts the cylinder's main axis and is equipped with a torque limiter to protect the one or two mainsprings from breaking due to excessive rewinding force. The rewinding mechanism is made so that the force required by the mainsprings can be reduced and the drive period increased.

One or two external power supply shafts can be linked to the cylinder so that the main springs drive the cylinders which in turn drive the one or two external power supply shafts to operate objects outside of the music box. The one or two external power supply shafts may be placed alternately in one or two or, where necessary, three openings provided for that purpose on the two frame halves. In this way it is possible to combine the placement of the rewinding mechanism and the one or two power supply shafts in the positions best adapted to the application.

A regulator, centrifugal stabilizer of the musical tempo, contains a rotating system of heads placed on expanding stretch arms. The regulator on the one hand provides an esthetically pleasing animation and on the other, maintains a linear musical tempo over the entire time the mechanism is in motion.

Spring pins are inserted in and attached to the grooves provided in the frame halves. Each spring pin represents one note which can be struck by a lifting cam of the roller with a minimum of operation and is made without needing major refinishing to produce regular musical notes. Each spring pin may also include a mute when a note requires muting.

One or two cases halves attach to the frame halves to enclose the set of components and to form a resonance chamber for the music.

The sum of the advantages offered by the former principle and components make possible (1) a logical and harmonious division of functions, shapes, and tones, (2) a reduction in the number of effective parts and multifunctionality of a number of components, (3) positioning of the rewinding mechanism in three possible positions, protected by a torque limiter, (4) one or two external power supply shafts which can be built with different drive ratios, (5) the absence of screws, dowels, or other holding devices to align or fix the components, and (6) a decrease in the number of required components by placing the spring pins on one side of the speed regulation system.

These and other features, aspects, and advantages of the present invention will become better understood with regard to the following description, appended claims and accompanying drawings.

DETAILED DESCRIPTION

Figure 1:
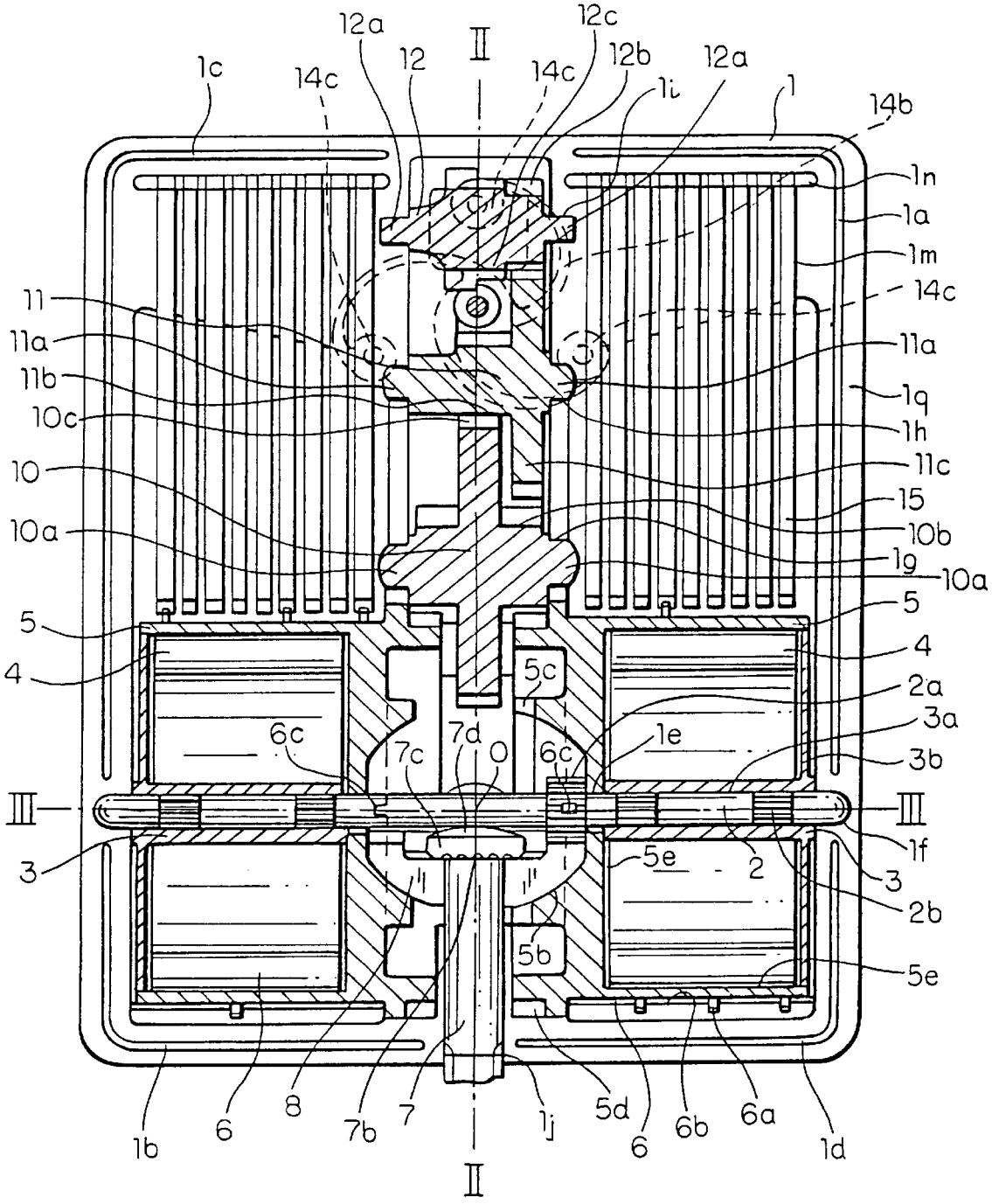
FIG. 1 represents an enlarged cross-sectional front view of the assembled music box taken on line I—I of FIG. 2.

FIGS. 1 through 10, without being unique or limited to other possible types, sizes, and variations, represent a mechanical music box having eighteen spring pins (18 notes) which operate on an analog principle. The mechanical music box includes, in approximate order of assembly, two frame halves 1, which, when placed end to end, support and enclose a central axis 2 supporting two cores 3, two spiral springs 4, two cylinders 5, two rollers 6, a rewinding shaft 7, rewinding ring 8, one or two external power supply shafts 9, a large sprocket 10, a medium sprocket 11, a small sprocket 12, a worm gear 13, two wheels regulating the musical tempo 14, and spring pins 15. This whole assembly is enclosed by two case halves 16.

Figure 2:
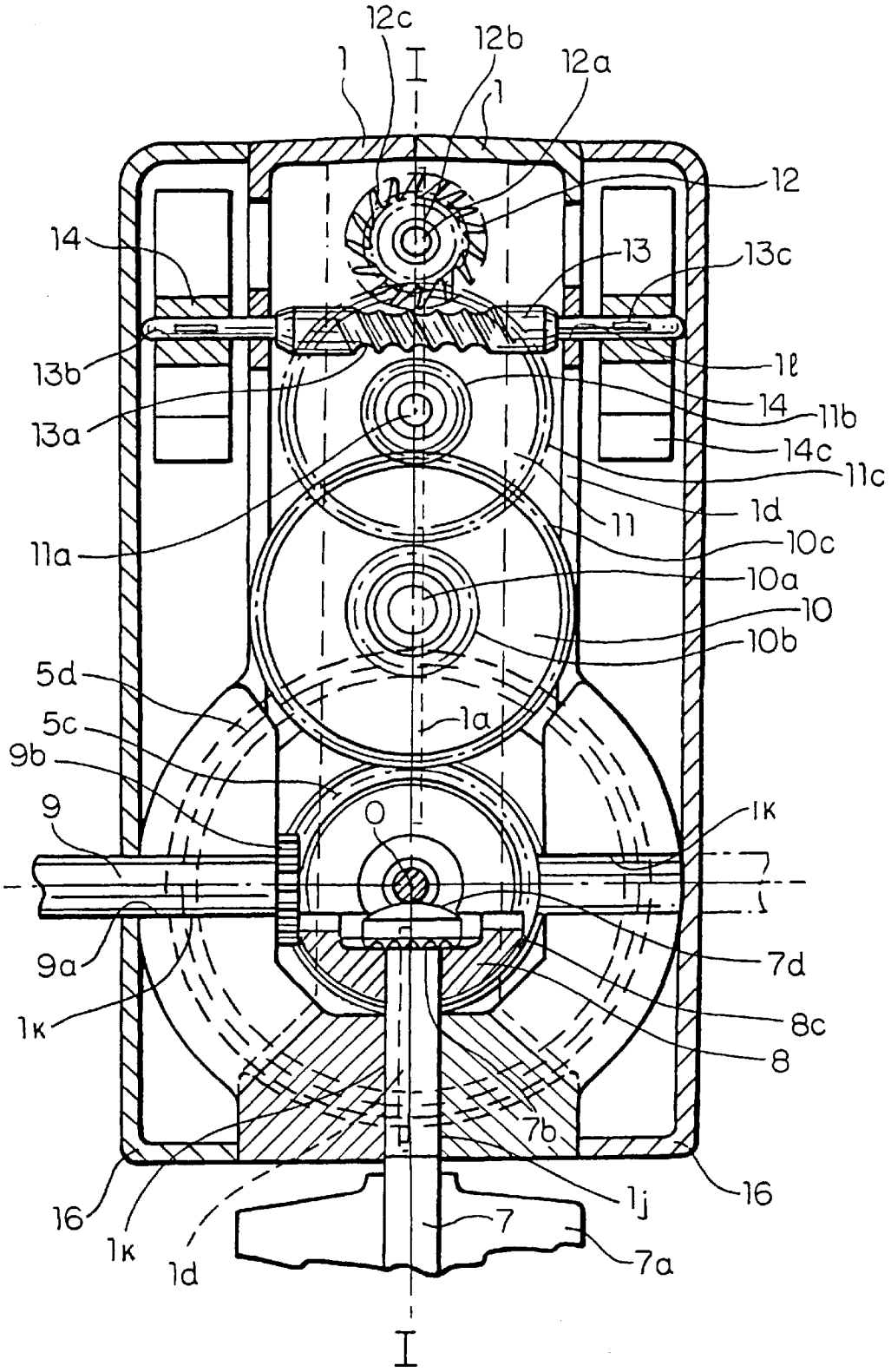
FIG. 2 represents an enlarged cross-sectional side view of the assembled music box taken on line II—II of FIG. 1.
Figure 3:
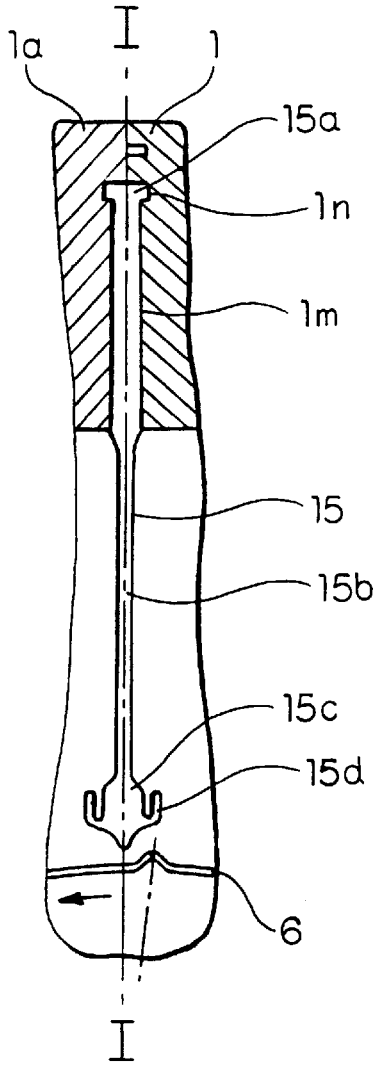
FIG. 3 represents an enlarged cross-sectional side view of an installed spring pin, roller and spring pin lifting cam taken on line II—II of FIG. 1.
Figure 4:
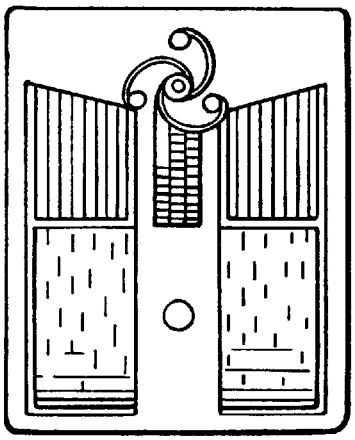
FIG. 4 represents in an approximate scale a representative front view of an eighteen spring pin mechanical music box.
Figure 7:
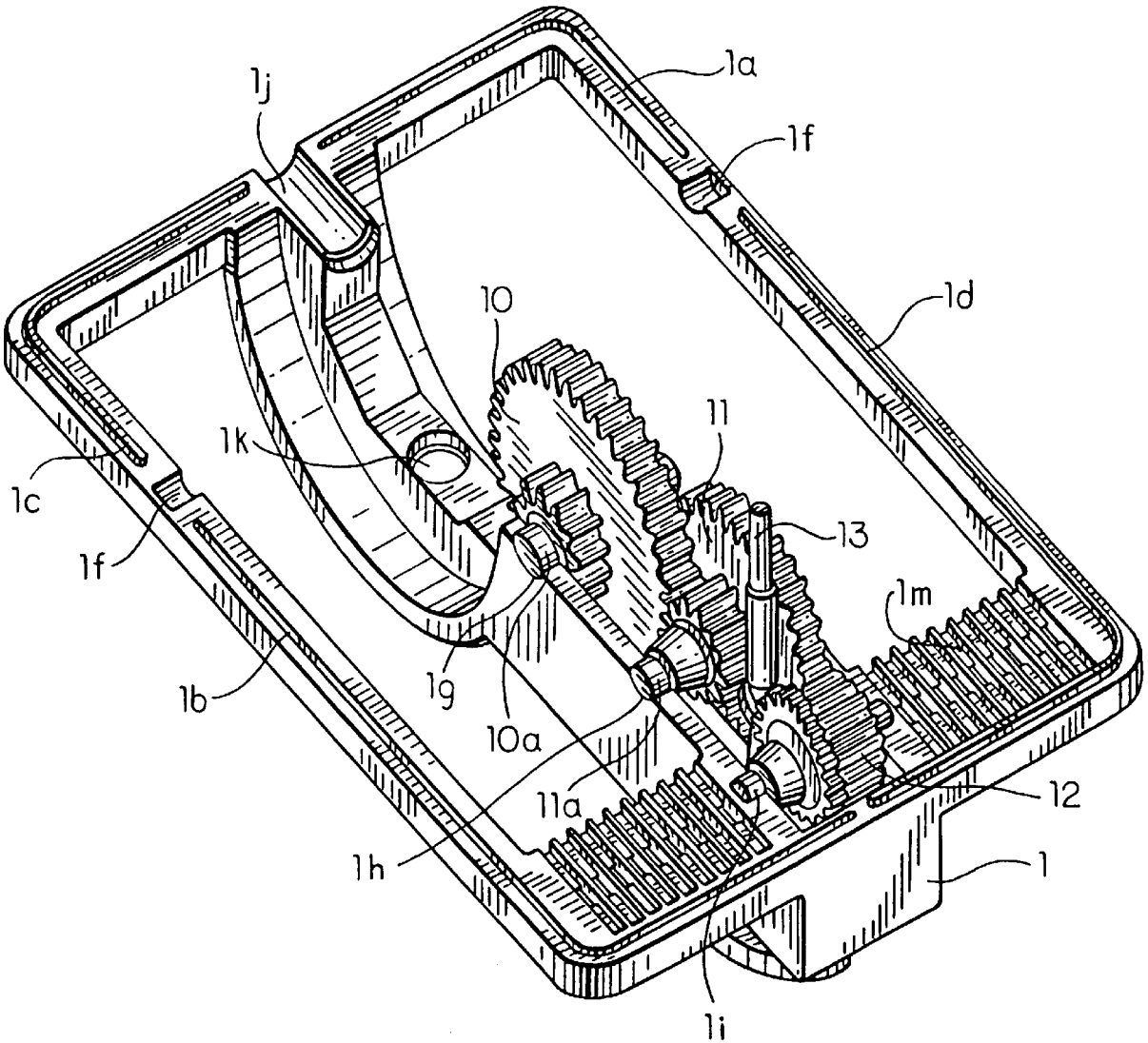
FIG. 7 represents an perspective view of the music box frame half with the tempo regulator components assembled.

Referring to FIGS. 1, 2 and 7, frame halves 1 support and hold the components in half bearings, slots and grooves 1*e*–1*n* formed in the half frames. Each frame also half has grooves 1*a* and 1*b* and tongues 1*c* and 1*d*. When the frame halves are placed end to end, the frame half tongues 1*c* and 1*d*, and grooves 1*a* and 1*b* mate with the tongues 1*c* and 1*d*, and grooves 1*a* and 1*b* of the opposing frame half to align and center the halves and the components. The joined halves support and enclose all of the components 2 through 13.

Figure 6:
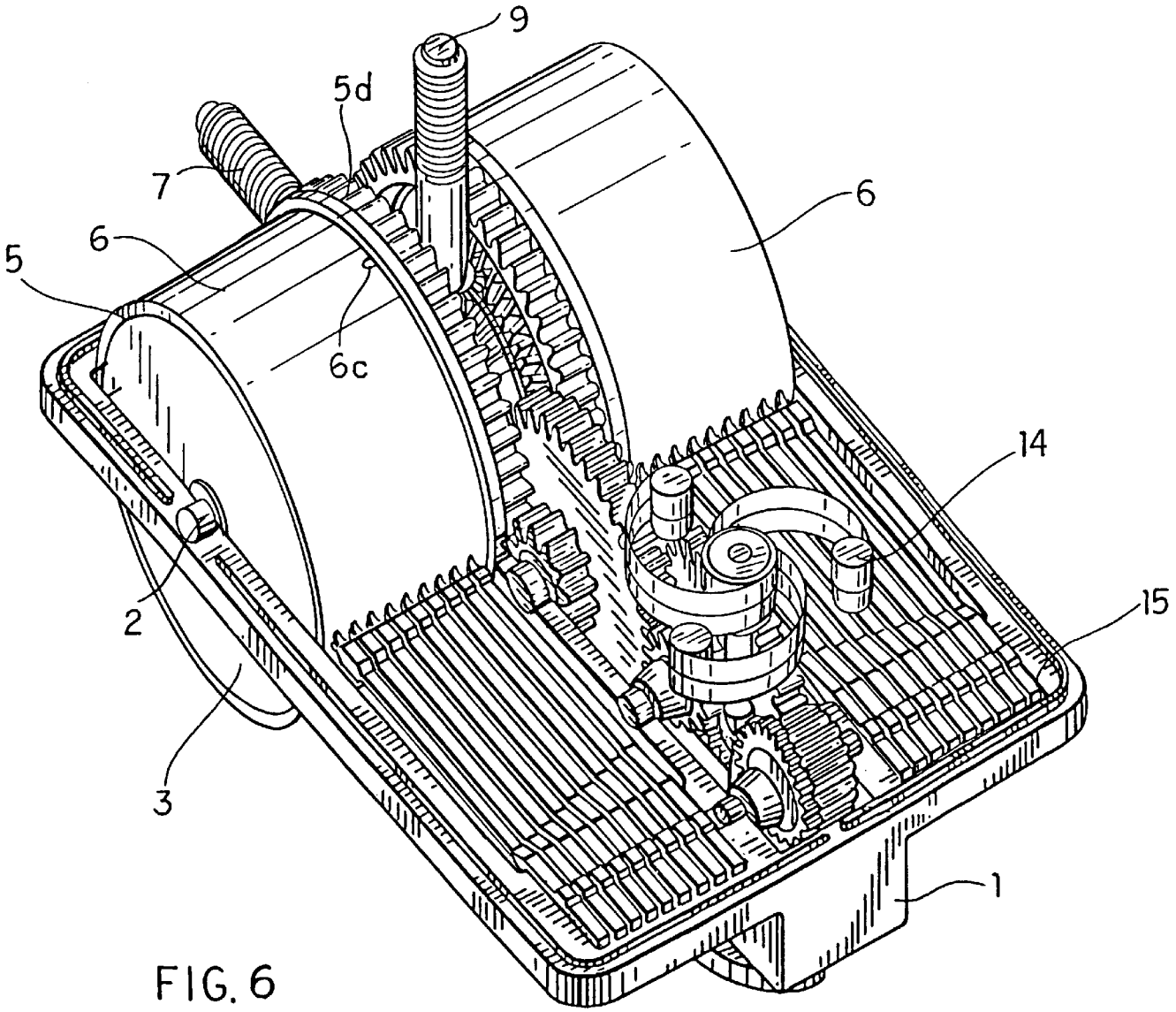
FIG. 6 represents an perspective view of the music box components assembled on one frame half.
Figure 10:
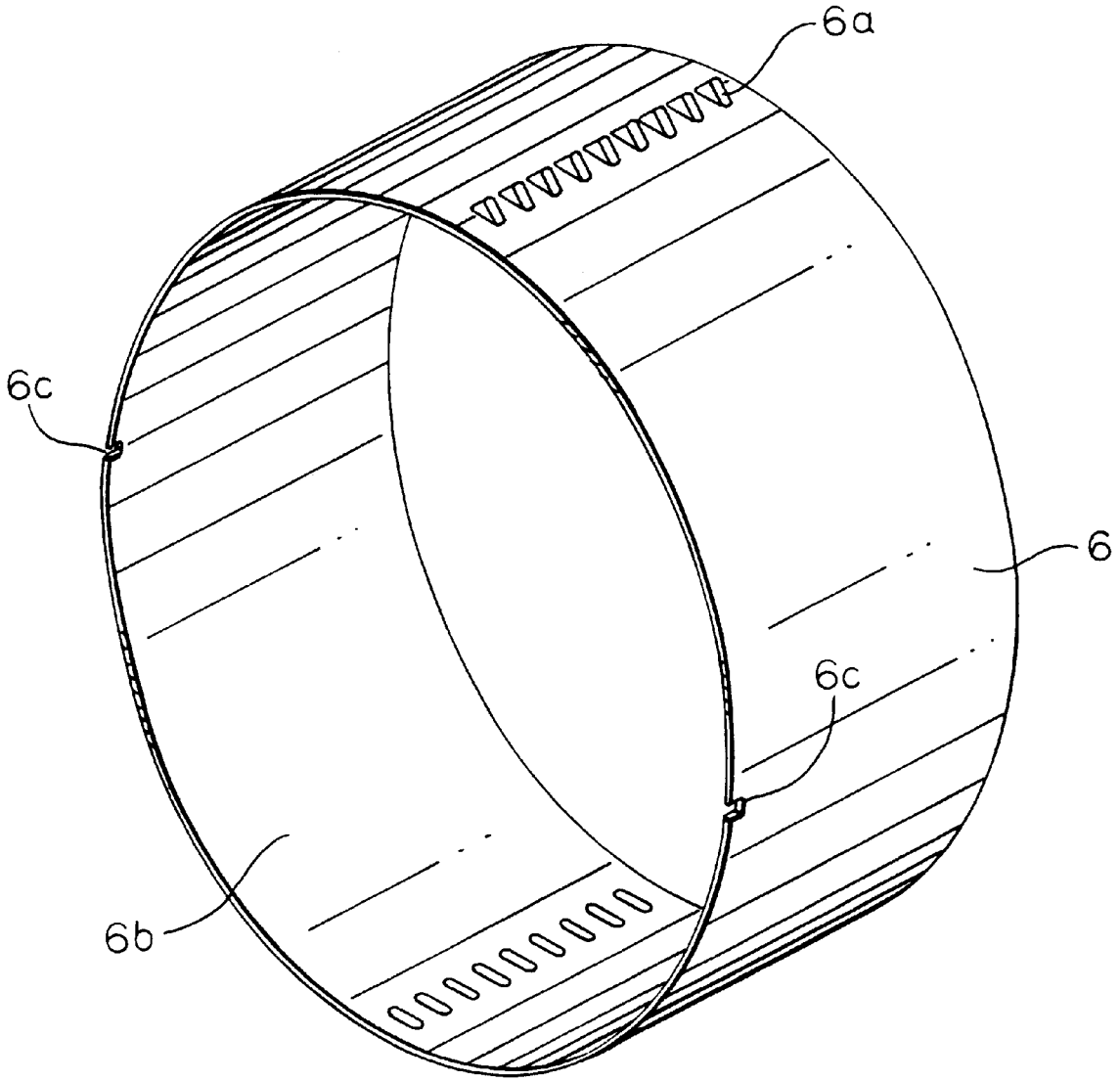
FIG. 10 represents an perspective view of the roller.

Referring to FIGS. 1, 6 and 10, central axis 2 is rotatably supported by bearings 1*f* of frame halves 1. Central axis 2 supports cores 3, one or more spiral springs 4, cylinders 5, and the rollers 6 having lifting cams 6*a*. Central axis 2 comprises a cylindrical shaft having a sprocket 2*a* which is engaged by the rewinding shaft 7, and straight "strillures" 2*b* which engage and drive cores 3.

Figure 9:
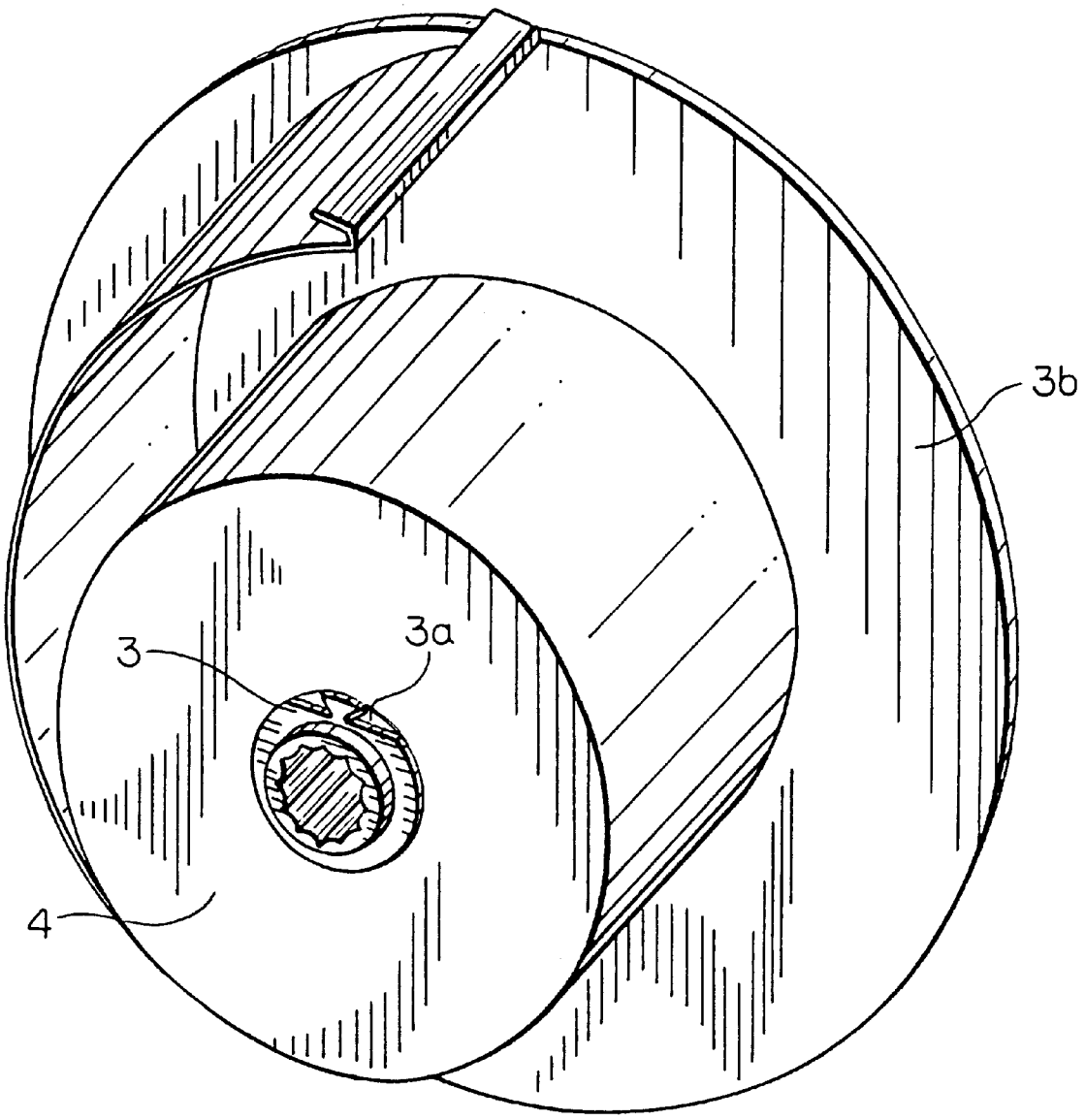
FIG. 9 represents an perspective view of a spiral spring assembled on the core.

Referring to FIG. 9, cores 3 have a tubular shaft which slide over and engage the strillures 2*b* of central axis 2, a central grooved channel 3*a* which holds the lower part of spiral spring 4, and a radially extending flange 3*b* which guides and holds cylinder 5.

Figure 8:
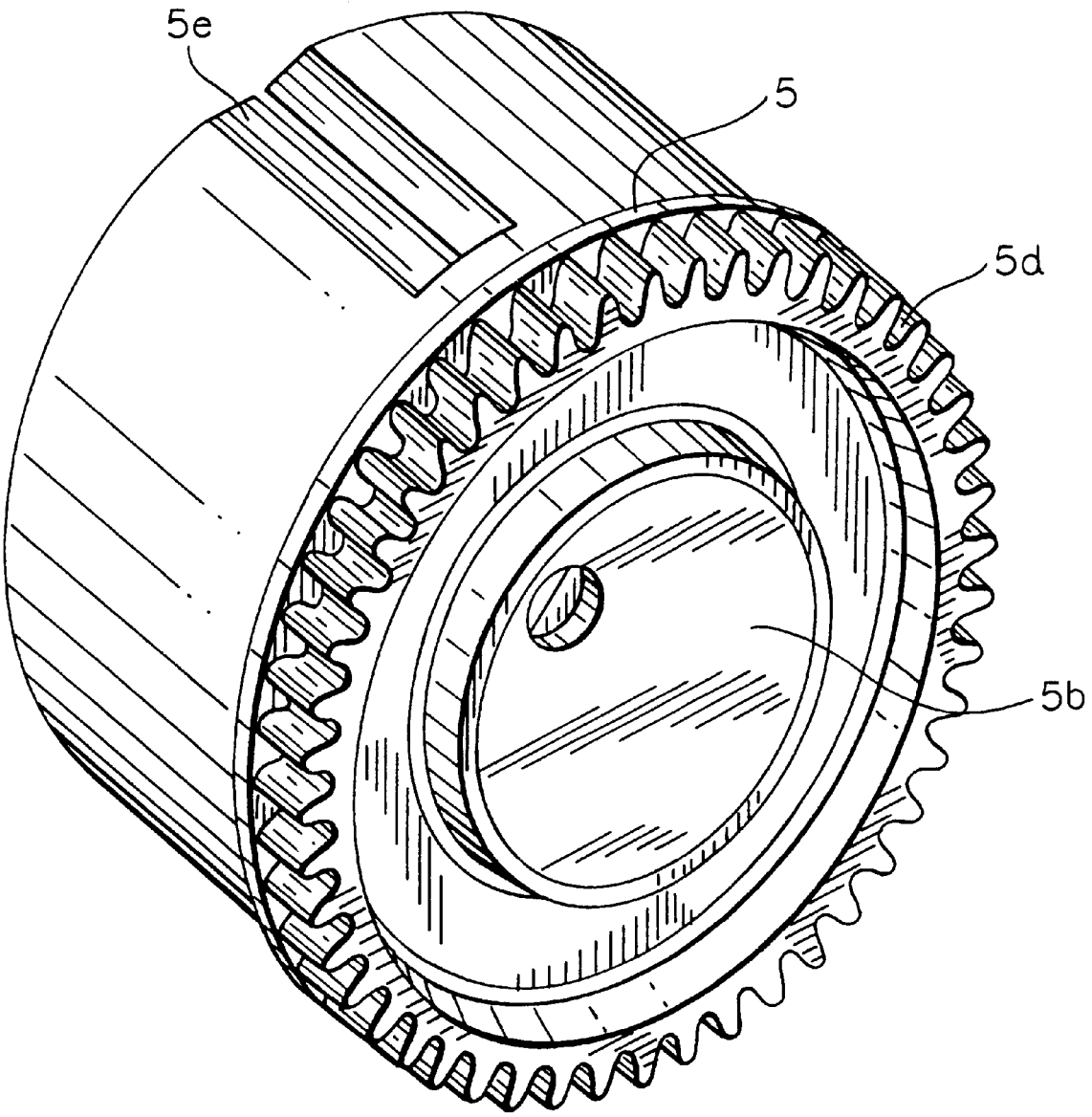
FIG. 8 represents an perspective view of a cylinder without the gear for driving external power supply shafts.

Referring to FIG. 8 and 10, cylinders 5, support rollers 6, and have grooves 5*e* for attaching the spiral springs 4. Cylinders 5 further include ring gears 5*d* that engages sprocket 10 of the musical tempo regulator and ring gears 5*c* used to drive the external power supply shafts 9 when an external power supply shaft is used. Cylinder 5 forms a hemispherical housing 5*b* surrounding ring gear 8. Cylinders 5 are freely supported by and rotatable around cores 3.

Referring to FIGS. 8 and 10, the rollers 6 slide onto cylinders 5. Each cylinder 6 has a notch 6*c* which engages cylinder 5 to align and drive the rollers 6. The rollers 6 have cams 6*a* arranged to strike the spring pins 15 in a sequence to produce the desired melody. The cams 6*a* are press formed from the inside of the roller tube 6*b*.

Referring to FIGS. 8 and 9, the spiral springs 4 disposed inside the cylinders 5 drive the musical instrument and the adaptable external power supply shafts 9. The spiral springs consist of a wound steel coils with hooked ends to wind it and to drive cylinder 5. One end of the spiral spring 4 is attached to central groove channel 3*a* of core 3 and the other end of the spiral spring 4 is attached to groove 5*e* in cylinder 5.

Referring to FIGS. 1 and 2, rewinding stem 7 has a winding key 7*a* connected to its outer end and a rewinding gear 7*c* at its inner end which drives ring gear 8. The rewinding gear 7*c* has slanted notching 7*b* and spherical part 7*d* propped against central axis 2 to act as a torque limiter.

The ring gear 8, engages the slanted notching 7*b* of the rewinding gear 7*b*, and engages and drives sprocket 2*a* of central axis 2 to tighten the spiral spring 4. Stop 8*c* is used to inhibit loss of tension on spiral spring 4 by using groove 5*e*.

External power supply shafts 9 may be used to drive linking parts outside the music box. The external power supply shafts 9 consist of a cylindrical shaft 9*a* supported by bearing 1*k* and a sprocket 9*b* engaging and driven by ring gear 5*c* of cylinder 5.

Referring to FIGS. 6 and 7, a musical tempo regulator is comprised of a large sprocket 10, a medium sprocket 11, a small sprocket 12, a worm gear 13 and wheels 14. The musical tempo regulator maintains a substantially constant rotational velocity of rollers 6 to maintain an even tempo of the music.

The large sprocket 10 contains two banks of pinions 10*b* and 10*c*. Pinion 10*b* engages ring gear 5*d*. The large sprocket 10 has two cylindrical bearing surfaces 10*a* which rotatably engage supporting bearings 1*g* of the frame halves 1.

The medium sprocket 11 contains two banks of pinions 11*b* and 11*c*. Pinion 11*b* engages pinion 10*c*. The medium sprocket 11 has two cylindrical bearing surfaces 11*a* which rotatably engage supporting bearings 1*h* of the frame halves 1.

The small sprocket 12 contains two banks of pinions 12*b* and 12*c*. Pinion 12*b* engages pinion 11*c* and pinion 12*c* engages worm gear 13. The small sprocket 12 has two cylindrical bearing surfaces 12*a* which rotatably engage supporting bearings 1*i* of the frame halves 1.

The worm gear 13 is placed perpendicular to the axis of sprocket 12 and is rotatably supported by bearings 1*e*.

The wheels 14 are affixed to the ends of the cylindrical shaft 13*b* of worm gear 13. Two pins 13*c* align the ends and wheels 14. The wheels 14 have stretch arms 14*b* having weighted heads 14*c*. The stretch arms 14*b* with weighted heads 14*c* extent radially as a result of increase centrifugal forces with increased rotational velocity.

Spring pins 15, each have a back portion 15*a*, a middle portion 15*b*, a front portion 15*c* and a small mute 15*d*. The spring pins 15 are placed individually in groove halves 1*m* in frame half 1. The rear part of the grooves In lock the spring pins 15 to prevent longitudinal movement of the spring pins 15 in grove 1*m*. The spring pins 15 are inserted axially with respect to I—I. The middle portion 15*b*, front portion 15*c* and small mute 15*d* of the spring pins 15 produce the musical tone when the spring pin 15 is lifted and released by the lifting cams 6*a* as the rollers 6 rotate. The part in front of 15*c* is used to give the note the desired pitch and may contain a small mute 15*d* residual resonance at the top of part 15*c*.

Figure 5:
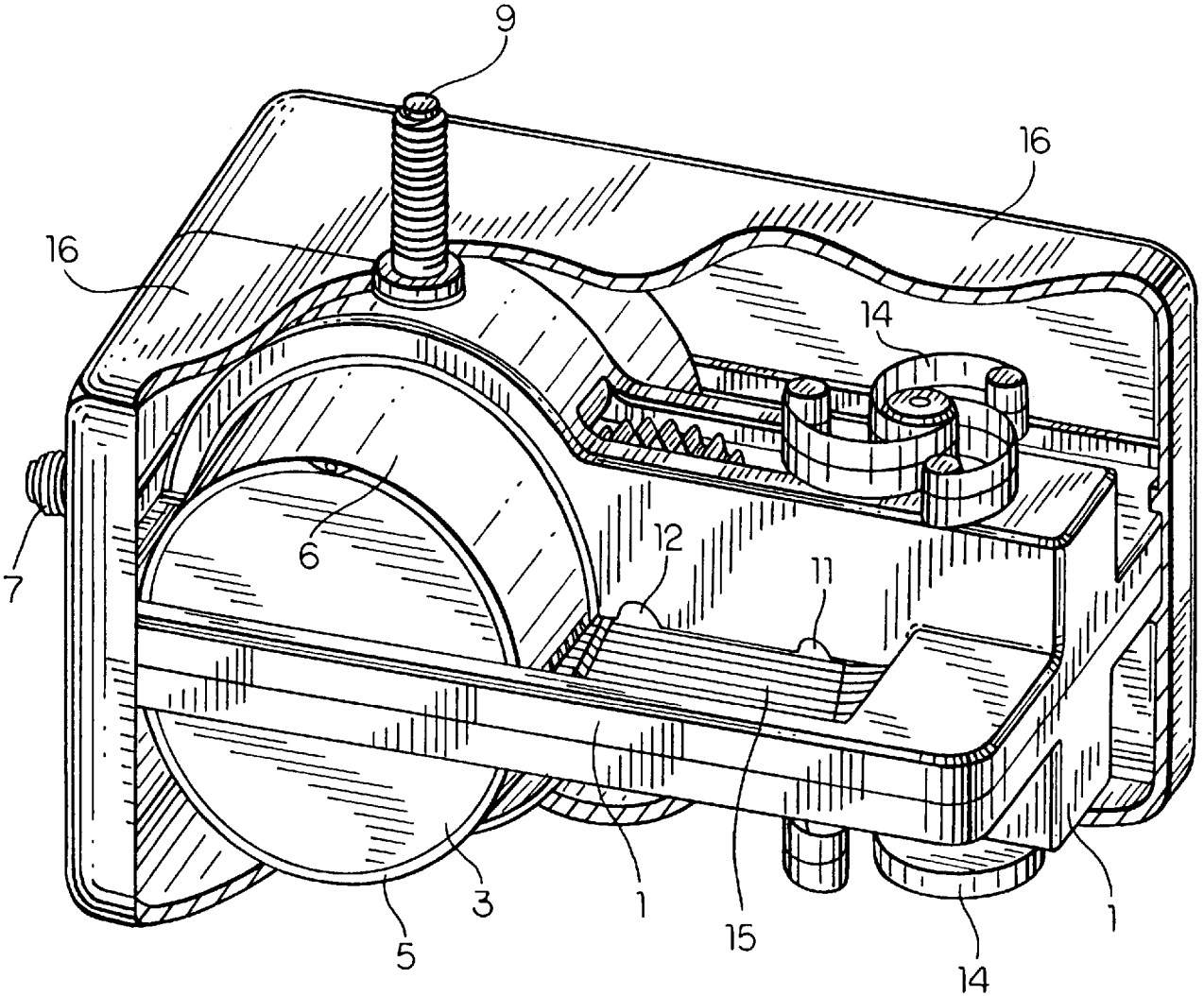
FIG. 5 represents an perspective view of the assembled music box with the case cut away.

Referring to FIG. 5, case halves 16 slide on sides 1*q* of frame halves 1 and are soldered or cemented end to end, forming a case which completely encloses all components 1 through 15, with the exception of rewinding shaft 7 and external power supply shafts 9. These two case halves 16 produce the desired resonance and the means of attachment for the various possible applications.

At the state of the art, the distinction is not sufficiently clear for this type of product to be competitive. Even if the degree of technical sophistication has enabled it to achieve lasting fame, we have to abandon traditional manufacturing techniques in favor of innovations.

A relatively simple to manufacture music box is described in Swiss Patent No. CH-586 441. This music box contains a cylinder (4) equipped with teeth (5) to work vibrating pins (3). In one of its embodiments, a spring (20) is placed inside the cylinder to get it to rotate. The music box pieces are placed in a case (1).

Though it works perfectly well, this music box involves a number of problems. The case consists of two parts which make it possible to position and hold the music box parts. However, these two parts are not identical. They therefore have to be made using two different molds. Manufacturing cost is therefore rather high. The music box contains one or two combs [keyboards]. If, during production, one of the pins breaks or cannot be used for some other reason, the entire comb is unusable. The rewinding mechanism is firmly attached to the cylinder. This means that it cannot be attached in other positions, nor can it have a different shape. This music box, therefore, cannot be adapted and modified to different embodiments. Finally, it impossible to add a power source to this music box. All of these drawbacks indicate that the music box described in this document is largely inflexible and cannot be adapted to different uses.

Swiss Patent No. CH-256 248 describes a music box with individual vibrating tabs in place of the vibrating pins on combs found in conventional music boxes. Attaching the tabs in this music box is relatively complicated, making assembly expensive.

The present invention, characterized by Claims 1 through 10, is aimed at solving all of the above problems.

The salient features described above in presenting the invention are primarily characterized by the fact that the majority of the parts making up this mechanical music box are assembled between two identical frame halves.

Placed end to end, these two frame halves enclose the components, by placing them on radial open bearings located on the median axis of the mating surface. This feature, which makes it easier to assemble and hold the components, represents, as will be demonstrated below, the organization of the new product's concept and general structure.

The sum of the advantages offered by the former principle makes possible a logical and harmonious division of functions, shapes, and tones, a reduction in the number of effective parts, multifunctionality of a number of components, positioning of the rewinding mechanism in three possible position, protected by a torque limiter, one or two external power sources which can be built with different drive ratios, the absence of screws, dowels, or other holding devices to align or fix the components, the possibility of different versions, decreasing

What is claimed is:

1. A music box, in particular for musical movements, snuffboxes, toys, stuffed animals, boxes, and various display units, meant to produce at least one tune, comprising:

two identical frame halves;

a central axis rotatable supported by the frame halves;

two cylinders freely supported by cores firmly attached to a central axis;

at least one spiral spring one of whose ends is firmly attached to the core and the other end firmly attached to the cylinder;

a roller driven by each cylinder and equipped with lifting cams working in conjunction with at least one spring pin made to produce a note of the referenced tune, the spring pins being arranged in such a way as to produce all of the notes of the tune;

a system for regulating the speed of the cylinder;

a drive mechanism for the referenced system for regulating the speed of the cylinder, said drive mechanism having a large sprocket, a medium sprocket, and a small sprocket; and a rewinding mechanism arranged between the two cylinders and having a shaft firmly attached to a ring gear, the ring gear working in conjunction with a sprocket firmly attached to the central axis and arranged to retain the spiral spring.

2. The music box according to claim 1, wherein each of the two frame halves (1) have bearings for aligning and holding the cylinders (5) and the drive mechanism sprockets (10, 11, 12).

3. The music box according to claim 1, wherein each of the two frame halves (1) have tongues and grooves equipped to position the two frame halves with respect to each other after the parts constituting the music box are placed in one of the frame halves.

4. The music box according to claim 1, wherein the system regulating the rotation speed of the cylinder contains a worm gear (13) held in place by the two frame halves (1), at least one of the ends of the worm gear containing a wheel (14) consisting of extending stretch arms (14*b*) wherein each stretch arm is equipped with a head (14*c*).

5. The music box according to claim 1, wherein the two cylinders (5) contain an internal ring gear (5*c*) geared with a sprocket (9*b*) of at least one power supply shaft (9).

6. The music box according to claim 1, further including a rewinding mechanism torque limiter (7*b*) consisting of notching arranged between a rewinding shaft (7) and a ring gear (8) firmly attached to the rewinding mechanism.

7. The music box according to claim 1, further including case halves (16) attached to the sides (1*q*) of the frame halves (1).

8. A music box, in particular for musical movements, snuffboxes, toys, stuffed animals, boxes, and various display units, meant to produce at least one tune, comprising:

two identical frame halves;

a central axis rotatably supported by the frame halves;

two cylinders (5), freely supported by cores firmly attached to the central axis, having a ring gear (5*d*) engaging a large sprocket (10);

at least one spiral spring one of whose ends is firmly attached to the core and the other end firmly attached to the cylinder;

a roller driven by each cylinder and equipped with lifting cams working in conjunction with at least one spring pin made to produce a note of the referenced tune, the spring pins being arranged in such a way as to produce all of the notes of the tune;

a system for regulating the speed of the cylinder;

a drive mechanism for the referenced system for regulating the speed of the cylinder, said drive mechanism having the large sprocket, a medium sprocket, and a small sprocket; and a rewinding mechanism, arranged between the two cylinders, working in conjunction with the central axis and arranged to retain the spiral spring.

9. A music box, in particular for musical movements, snuffboxes, toys, stuffed animals, boxes, and various display units, meant to produce at least one tune, comprising:

two identical frame halves;

a central axis rotatable supported by the frame halves;

at least one cylinder freely supported by cores firmly attached to the central axis;

at least one spiral spring one of whose ends is firmly attached to the core and the other end firmly attached to the cylinder;

a roller driven by each cylinder and equipped with lifting cams working in conjunction with at least one spring pin made to produce a note of the referenced tune, the spring pins each having a substantially identical length, a part producing a musical tone, a rear part used to position each spring pin (15) in a separate groove (1*m*) in the frame halves (1), and a front part used to give the spring pin a desired pitch, the spring pins being arranged in such a way as to produce all of the notes of the tune;

a system for regulating the speed of the cylinder;

a drive mechanism for the referenced system for regulating the speed of the cylinder, said drive mechanism having a large sprocket, a medium sprocket, and a small sprocket; and a rewinding mechanism working in conjunction with the central axis and arranged to retain the spiral spring.

* * * * *